US010056671B2

(12) United States Patent
Shinohara et al.

(10) Patent No.: US 10,056,671 B2
(45) Date of Patent: Aug. 21, 2018

(54) WAVEGUIDE TYPE POWER COMBINING/DIVIDING UNIT

(71) Applicant: Nihon Koshuha Co., Ltd., Yokohama-shi (JP)

(72) Inventors: Kibatsu Shinohara, Yokohama (JP); Shuichi Aizawa, Yokohama (JP); Yutaka Arisumi, Yokohama (JP)

(73) Assignee: Nihon Koshuha Co., Ltd., Yokohama-shi (JP)

( * ) Notice: Subject to any disclaimer, the term of this patent is extended or adjusted under 35 U.S.C. 154(b) by 0 days.

(21) Appl. No.: 15/501,285

(22) PCT Filed: Sep. 10, 2014

(86) PCT No.: PCT/JP2014/073979

§ 371 (c)(1),
(2) Date: Feb. 2, 2017

(87) PCT Pub. No.: WO2016/024362

PCT Pub. Date: Feb. 18, 2016

(65) Prior Publication Data

US 2017/0222294 A1 Aug. 3, 2017

(30) Foreign Application Priority Data

Aug. 12, 2014 (JP) ..... 2014-164111

(51) Int. Cl.

| | |
|---|---|
| ***H01P 5/12*** | (2006.01) |
| ***H01P 5/08*** | (2006.01) |
| ***H01P 5/19*** | (2006.01) |
| ***H01P 3/123*** | (2006.01) |

(52) U.S. Cl.
CPC ..... *H01P 5/082* (2013.01); *H01P 3/123* (2013.01); *H01P 5/19* (2013.01)

(58) Field of Classification Search
CPC ..... H01P 5/082; H01P 5/19
See application file for complete search history.

(56) References Cited

U.S. PATENT DOCUMENTS 4,922,215 A 5/1990 Bergero et al.
4,973,924 A * 11/1990 Bergero ..... H01J 25/025 333/137

FOREIGN PATENT DOCUMENTS

| | | | |
|---|---|---|---|
| JP | 50-105050 | A | 8/1975 |
| JP | 02-009204 | A | 1/1990 |
| JP | 09-116302 | A | 5/1997 |
| JP | 2010-166226 | A | 7/2010 |
| JP | 2013-150143 | A | 8/2013 |

OTHER PUBLICATIONS

International Search Report dated Oct. 7, 2014, issued for PCT/JP2014/073979.

* cited by examiner

*Primary Examiner* — Robert J Pascal
*Assistant Examiner* — Kimberly Glenn
(74) *Attorney, Agent, or Firm* — Locke Lord LLP

(57) ABSTRACT

A waveguide type power combining/dividing unit W includes a plurality of rectangular waveguides 1 for TE10 mode disposed in a radial pattern, a circular waveguide 2 for TM01 mode disposed at a center of the radial pattern, in which one ends of the plurality of the rectangular waveguides 1 are connected to a side surface of one end of the circular waveguide.

6 Claims, 4 Drawing Sheets

(a)

(b)

WAVEGUIDE TYPE POWER COMBINING/DIVIDING UNIT

TECHNICAL FIELD

The present invention relates to a waveguide type power combining/dividing unit and, more particularly, to a waveguide type power combining/dividing unit used to combine or divide high electric power in, for example, a microwave band or millimeter wave band.

BACKGROUND ART

A power combining unit that obtains high output electric power by combining a plurality of electric power inputs is known as one means for obtaining an output of high electric power. This power combining unit includes a plurality of input ends to which electric power is input and an output end from which the combined electric power is output. In addition, the electric power combining/dividing unit functions as a power dividing unit if the input ends are used as an output end and the output end is used as an input end. Therefore, "a power combining unit" and "a power dividing unit" are referred to as an electric power combining/dividing unit in this specification.

Such an electric power combining/dividing unit as described above is disclosed in, for example, PTL 1. The electric power combining/dividing unit disclosed in PTL 1 includes a main body having a void therein, a central coaxial plug provided substantially at the center of the main body, a plurality of peripheral coaxial plugs, arranged concentrically about the central coaxial plug, that is installed in the main body, a radial line formed in the void in the main body, a central coaxial line having one end connected to the central coaxial plug and the other end connected to the center of the radial line, and a peripheral coaxial line having one end connected to the peripheral coaxial plug and the other end connected to the outer peripheral part of the radial line. This electric power combining/dividing unit functions as a power combining unit when the central coaxial plug is used as an output terminal and the peripheral coaxial plug is used as an input terminal or functions as a power dividing unit when the central coaxial plug is used as an input terminal and the peripheral coaxial plug is used as an output terminal.

In order to achieve combined output having high electric power, the multistage connection of the electric power combining/dividing units (the multistage connection of a plurality of electric power combining/dividing units) disclosed in PTL 1 is performed to obtain desired high output electric power.

Since a coaxial line has larger transmission loss and lower electric power resistance than a waveguide line, the cutoff frequency becomes low when a coaxial line having a large diameter is used and there are limitations in application to a high frequency band and high electric power.

CITATION LIST

Patent Literature

PTL 1: JP-A-2013-150143

SUMMARY OF INVENTION

Technical Problem

In recent years, due to improvement of the performance of semiconductor elements used in a power amplifier disposed as the preceding stage of an electric power combining/dividing unit, the output from the power amplifier has high electric power. Accordingly, when an input end is configured by a waveguide used as a transmission path for high electric power output from a power amplifier or the like in an electric power combining/dividing unit that functions as a power combining unit, as in the prior art described above, high output electric power can be obtained without using the structure in which multistage connection of a plurality of electric power combining/dividing units (electric power combining/dividing units having input ends of coaxial plugs) is performed.

However, at present, there is no electric power combining/dividing unit in which a plurality of input ends is configured by waveguides used as transmission paths for high electric power.

The invention addresses the above problem with an object of providing an electric power combining/dividing unit capable of combining or dividing high electric power without using the structure in which multistage connection of a plurality of electric power combining/dividing units is performed.

Solution to Problem

The invention devised to address the above problem is a waveguide type power combining/dividing unit including a plurality of rectangular waveguides for TE10 mode disposed in a radial pattern and a circular waveguide for TM01 mode disposed at a center of the radial pattern so as to extend orthogonally to a surface of the radial pattern, in which one ends of the plurality of rectangular waveguides are connected to a side surface of one end of the circular waveguide.

In the above structure, the waveguide type power combining/dividing unit can function as a power combining unit in which, when the other ends of the rectangular waveguides are used as input ends to which electric power is input, the electric power from the input ends is input to the circular waveguide and then combined, and the combined electric power is output from the other end of the circular waveguide.

That is, according to the invention, since it is possible to configure the electric power combining/dividing unit having, as the input ends, the plurality of rectangular waveguides functioning as high electric power transmission paths and having the other end of the circular waveguide as the input end, high electric power can be combined without having the structure in which the multistage connection of the electric power combining/dividing units having the input ends of coaxial plugs is performed. In addition, since it is possible to configure the electric power combining/dividing unit having the plurality of rectangular waveguides as output ends and the other end of the circular waveguide as an input end, high electric power can be divided without having the structure in which the multistage connection of the electric power combining/dividing units having the input ends of coaxial plugs is performed.

As a result, according to the invention, the facility cost and installation cost can be significantly reduced as compared with the prior art described above.

In addition, preferably, either or both of the width of H-planes and the width of E-planes of the rectangular waveguides are reduced from the other ends of the rectangular waveguides to one ends connected to the circular waveguide and a ridge is provided in one or both of the H-planes.

In the above example, the width of the rectangular waveguide may be linearly reduced from the other end to one end or may be reduced stepwise.

Since either or both of the width of the H-planes and the width of the E-planes of the rectangular waveguides are reduced from the other ends to one ends connected to the circular waveguide, it is possible to release the mechanical limitations of the opening dimensions of the rectangular waveguides in the combining/dividing unit in which many input ends are configured by the rectangular waveguides.

The above mechanical limitations will be described using, as an example, an eight-synthesis electric power combining/dividing unit in which the frequency is 7 GHz, eight rectangular waveguides (TE10 mode) are used as input ends, and these rectangular waveguides are connected at regular intervals in the circumferential direction on the side surface of the circular waveguide (TM01 mode).

Specifically, when the frequency is 7 GHz, rectangular waveguides "WR-137" are generally used. Since the opening dimensions of "WR-137" are 34.85 mm×15.799 mm, the internal diameter of the circular waveguide to which eight rectangular waveguides (WR-137) are connected needs to be at least larger than the diameter (L=91.06 mm) of a circle circumscribing a regular octagon having sides of the length (34.85 mm) equal to the longer side (H-plane) of the rectangular waveguide.

On the other hand, the diameter (2*a*) of the circular waveguide having the frequency of 7 GHz as the cutoff frequency (wavelength λc=42.8571 mm) is 2×42.8571/2.613=32.803 mm because the relationship between the wavelength (λc) and the radius (a) of the circular waveguide for TM01 mode is "λc=2.613×a". However, to prevent sharp changes in the characteristics near the cutoff frequency, the diameter (2*a*) of the circular waveguide needs to be obtained by multiplying the above calculated value by approximately 1.2. In addition, since the wavelength (λc) of the frequency of 7 GHz is 42.8571 mm, the diameter of the circular waveguide needs to be smaller than this value to prevent occurrence of a different mode. Accordingly, the diameter of the circular waveguide needs to be approximately 40 mm. However, when the eight rectangular waveguides (TE10 mode) are connected to the circular waveguide as input ends, since the diameter of the circular waveguide needs to be larger than "91.06 mm" as described above, the 8-synthesis electric power combining/dividing unit cannot be configured.

Accordingly, the invention narrows the connection surface (opening dimensions) of the rectangular waveguide to the circular waveguide by reducing "either or both of the width of H-planes or the width of E-planes of the rectangular waveguides from the other ends of the rectangular waveguides toward one ends connected to the circular waveguide", so that a desired number of rectangular waveguides can be connected to the circular waveguide for TE10 mode.

However, when the connection surface (opening dimensions) of the rectangular waveguide to the circular waveguide is narrowed as described above, a new problem occurs in which the cutoff frequency becomes high and transmission in a low frequency band of the used frequency band becomes difficult. For example, when the diameter of the circular waveguide is 40 mm and the opening dimensions of an eight-synthesizable rectangular waveguide are "15×8 mm", the cutoff frequency becomes 10.0 GHz and the frequency of 7 GHz, which is equal to or less than the cutoff frequency, cannot pass.

Accordingly, a ridge is provided on one or both of the H-planes of the rectangular waveguide in the invention and the dimensions of the ridge are selected, so that the cutoff frequency of TE10 mode is reduced and the frequency band characteristics are widened, thereby enabling use in a low frequency band. When, for example, the diameter of the circular waveguide is 40 mm and the opening dimensions of the connection surface of the eight-synthesizable rectangular waveguide are 15×8 mm as described above, if the dimensions of the ridge (single ridge) on the connection surface are 6 mm in width and 5.2 mm in height, the cutoff frequency becomes 5.714 GHz and the frequency of 7 GHz can pass.

In addition, preferably, grooves extending in a direction same with the axial direction of the circular waveguide are formed in the inner wall of the circular waveguide and a radio wave absorber is attached to the grooves.

The above structure is selected because of the following reasons.

Depending on the state of excitation on the circular waveguide or the like, TEmn mode (in which high-frequency current flows on the inner wall of the circular waveguide in the circumferential direction) occurs and interference with TE10 mode may distort the phase or increase transmission loss.

Therefore, the invention increases the resistance against high-frequency current flowing on the inner wall of the circular waveguide, makes it difficult to flow the high-frequency current, and suppresses the occurrence of unnecessary mode other than TM01 mode by adopting the above structure, that is, by forming grooves extending in the same direction as the axial direction of the circular waveguide and attaching a radio wave absorber to the groove (by filling the grooves with a radio wave absorber).

In addition, a mode converter for converting TM01 mode to TE10 mode is preferably connected to the other side of the circular waveguide.

The reason why this structure is adopted is that the transmission path is generally configured by rectangular waveguides. Since both ends (the input end and the output end) of the electric power combining/dividing unit are configured by the rectangular waveguides in the above structure, installation into a transmission path configured by the rectangular waveguides becomes easy.

Advantageous Effects of Invention

According to the invention, it is possible to provide an electric power combining/dividing unit for combining or dividing high electric power without using the structure in which multistage connection of a plurality of electric power combining/dividing units is performed.

DESCRIPTION OF EMBODIMENTS

A waveguide type power combining/dividing unit (referred to below simply as an electric power combining/dividing unit) according to an embodiment of the invention will be described with reference to the drawings. In the embodiment, for convenience of description, the case in which the electric power combining/dividing unit is used as a power combining unit is adopted as an example. In addition, the embodiment uses as an example, an eight-synthesis electric power combining/dividing unit W in which the frequency of 7 GHz is used and eight rectangular waveguides 1 are input ends.

Figure 1:
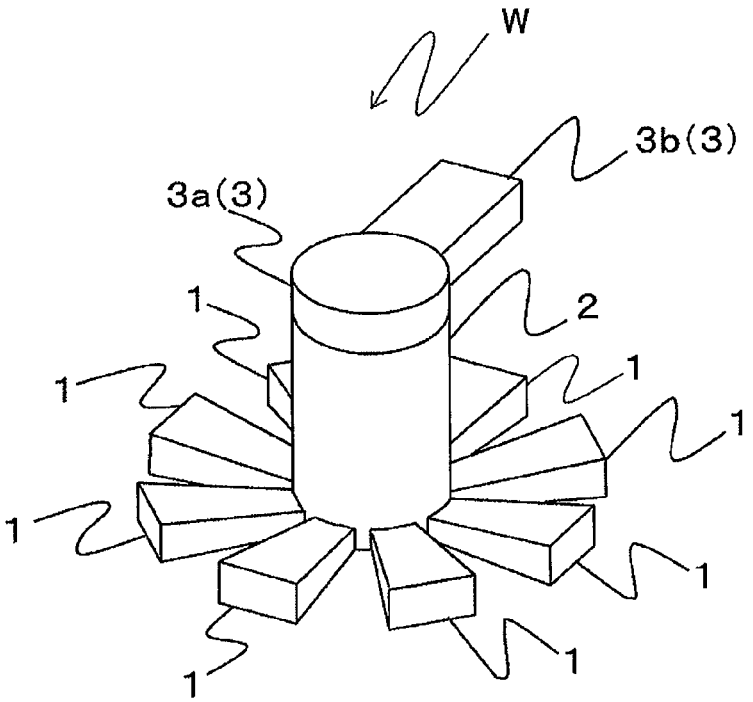
FIG. 1 is a schematic view illustrating the appearance of an electric power combining/dividing unit according to an embodiment of the invention.

As illustrated in FIG. 1, the electric power combining/dividing unit W according to the embodiment includes a plurality of (eight in the example in the drawing) rectangular waveguides 1 for TE10 mode, a circular waveguide 2 for TM01 mode, and a mode converter 3. Both ends of each of the rectangular waveguides 1 are open, one end (lower end in the drawing) of the circular waveguide is closed and the other end (upper end in the drawing) is open. The mode converter 3 has the structure in which a rectangular waveguide part 3*b* is connected to the outer peripheral surface of a circular waveguide part 3*a* and both ends of the mode converter 3 are open.

In addition, in the electric power combining/dividing unit W, the eight rectangular waveguides 1 are disposed radially centered on the circular waveguide 2, one ends of the rectangular waveguides 1 are connected to the outer peripheral surface of one end (lower end in the drawing) of the circular waveguide 2 (the eight rectangular waveguides 1 are connected at regular intervals in the circumferential direction to the outer peripheral surface of the circular waveguide 2). In addition, the mode converter 3 is connected to the other end (upper end side in the drawing) of the circular waveguide 2. The circular waveguide 2 for TM01 mode is disposed orthogonally to the radial surface of the rectangular waveguides 1 disposed radially.

Figure 2:
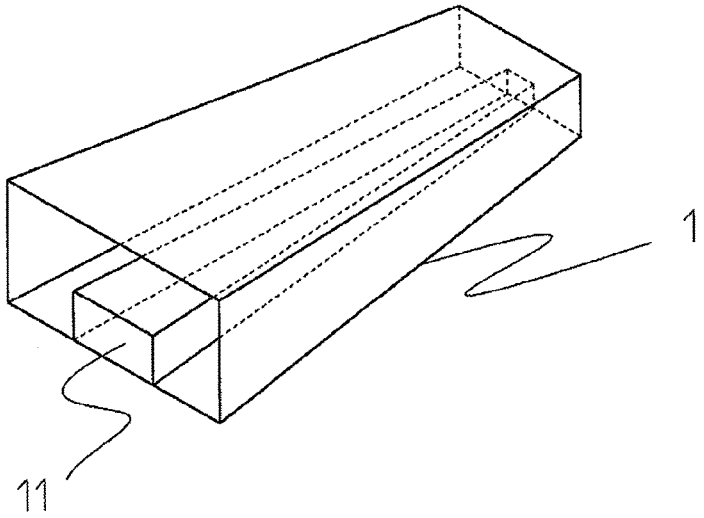
FIG. 2 is a schematic view used to describe a rectangular waveguide included in the electric power combining/dividing unit according to the embodiment of the invention.

In addition, as illustrated in FIG. 2, in the rectangular waveguide 1, the widths of H-planes (wide side) and E-planes are reduced (narrowed) from the other end of the rectangular waveguide 1 to one end (connection portion) connected to the circular waveguide 2. In the example illustrated in the drawing, the widths of the H-planes and the E-planes are linearly tapered from the other end to the connection portion.

Since the widths of the H-planes and the E-planes are linearly tapered from the other end to the connection portion as described above, the mechanical limitations of the opening dimensions of the rectangular waveguide 1 can be released and the number of the rectangular waveguides 1 that can be connected to the circular waveguide 2 can be increased.

For example, in the tapered rectangular waveguide 1, the opening dimensions of one end (connection portion) are 15 mm×8 mm and the opening dimensions of the other end are 34.85 mm×15.799 mm. In addition, the diameter of the circular waveguide 2 is 40 mm. In addition, in the mode converter 3, the diameter of the circular waveguide part 3*a* is 40 mm and the opening dimensions of the rectangular waveguide part 3*b* are 34.85×15.799 mm.

In the example illustrated in the drawing, although the widths of the H-planes and the E-planes of the rectangular waveguide 1 are linearly tapered from the other end to the connection portion, the invention is not particularly limited to this example. For example, the widths of the H-planes and the E-planes of the rectangular waveguide 1 may be reduced stepwise from the other end to the connection portion.

Although the widths of the H-planes (wide side) and the E-planes (narrow side) of the rectangular waveguide 1 are reduced from the other end of the rectangular waveguide 1 to the connection portion in the example illustrated in the drawing, the invention is not particularly limited to this example. The widths of only one of the H-planes (wide side) and the E-planes (narrow side) of the rectangular waveguide 1 may be narrowed.

In addition, as illustrated in FIG. 2, the rectangular waveguide 1 is provided with a ridge (back or block) 11 on the H-plane.

The reason why the ridge 11 is provided will be described below. Specifically, when the widths of the H-planes and the E-planes of the rectangular waveguide 1 are reduced from the other end to the connection portion (that is, when the opening dimensions of the connection portion of the rectangular waveguide 1 toward the circular waveguide 2 are reduced), the cutoff frequency becomes high, thereby making transmission in the low frequency band of the used frequency band difficult. Accordingly, the ridge 11 is provided on the H-plane of the rectangular waveguide 1 in the embodiment to lower the cutoff frequency in TE10 mode, thereby enabling use in a low frequency band. For example, when the opening dimensions of the connection portion of the rectangular waveguide 1 are 15×8 mm and the diameter of the circular waveguide 2 is 40 mm, if the dimensions of the single ridge 11 on the connection surface with the circular waveguide 2 are 6 mm in width and 5.2 mm in height, the cutoff frequency becomes 5.714 GHz and the frequency of 7 GHz can pass.

Although in FIG. 2, the rectangular waveguide 1 is formed by a waveguide (single ridge waveguide) in which one of the two H-planes is provided with the ridge 11, the rectangular waveguide 1 may be formed by a waveguide (double ridge waveguide) in which the two H-planes are provided with the ridges 11.

The waveguide (single ridge waveguide or double ridge waveguide) having the ridge 11 will be described with reference to FIGS. 3 and 4.

Figure 3:
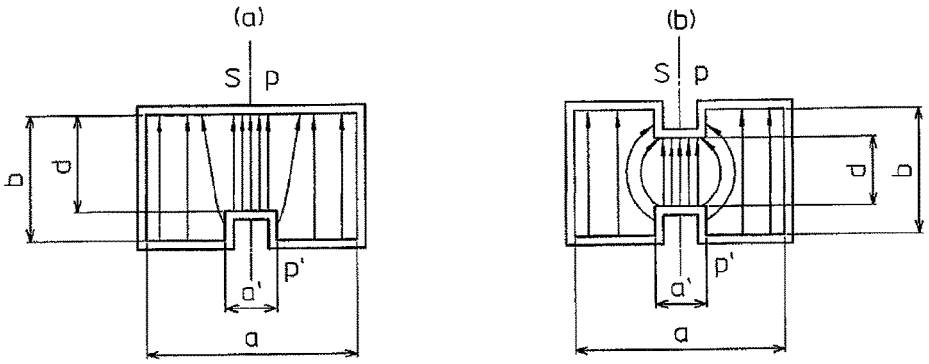
FIG. 3 is a schematic view used to describe a ridge waveguide, FIG. 3(*a*) is a schematic view illustrating a cross section of a single ridge waveguide and FIG. 3(*b*) is a schematic view illustrating a cross section of a double ridge waveguide.
Figure 4:
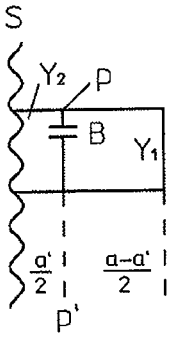
FIG. 4 is a schematic view illustrating an equivalent circuit of the ridge waveguide in FIG. 3.

The cross section (see FIG. 3 (*a*)) of a single ridge waveguide and the cross section (see FIG. 3 (*b*)) of a double ridge waveguide can be represented by an equivalent circuit (S in the drawing indicates the symmetric plane) illustrated in FIG. 4. In addition, the characteristic impedance (Y1) of the part of the ridge waveguide in which the ridge 11 is not formed is represented by [formula 1] below and the characteristic impedance (Y2) of the part in which the ridge 11 is formed is represented by [formula 2] below.

$$Y1 = \frac{K_\chi}{\omega\mu} \cdot \frac{1}{b} \quad \text{[formula 1]}$$

-continued $$Y2 = \frac{K_X}{\omega\mu} \cdot \frac{1}{d} \quad \text{[formula 2]}$$

In the ridge waveguide, the characteristic impedance (Y2) of the part of the ridge 11 and the capacitive susceptance (B) caused in the P-P' part in the drawing lower the cutoff frequency (fc) of the TE10 wave. In addition, since the cutoff frequencies (fc) of the TE20 wave and TE30 wave can be raised, the frequency band of the waveguide becomes wide.

Since electric fields concentrate in the ridge 11 part, capacitance is added equivalently, and the characteristic impedance is reduced by providing the ridge 11, matching can be performed easily.

Figure 6:
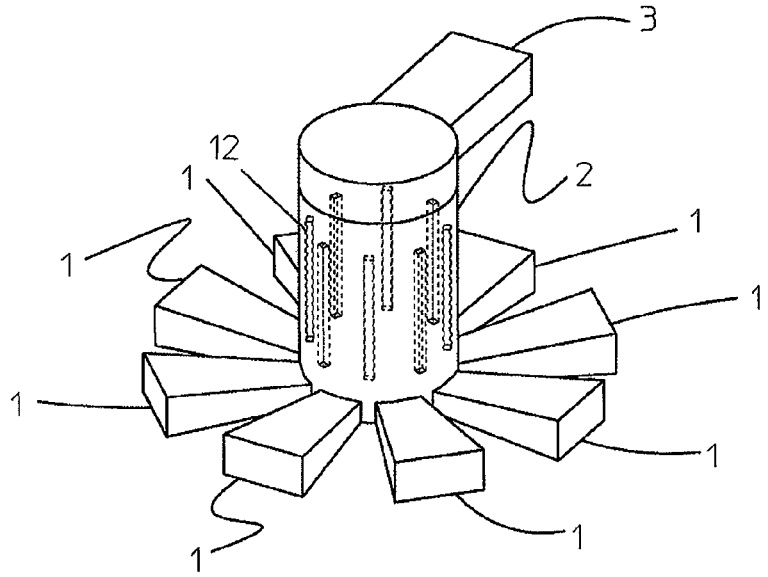
FIG. 6 is a schematic view used to describe the structure in which a radio wave absorber is attached to grooves formed in the inner wall of the circular waveguide of the electric power combining/dividing unit according to the embodiment of the invention, FIG. 6(*a*) is a schematic view of the electric power combining/dividing unit as seen from the obliquely upper side, and FIG. 6(*h*) is a plan view illustrating the circular waveguide of the electric power combining/dividing unit.
Figure 6:
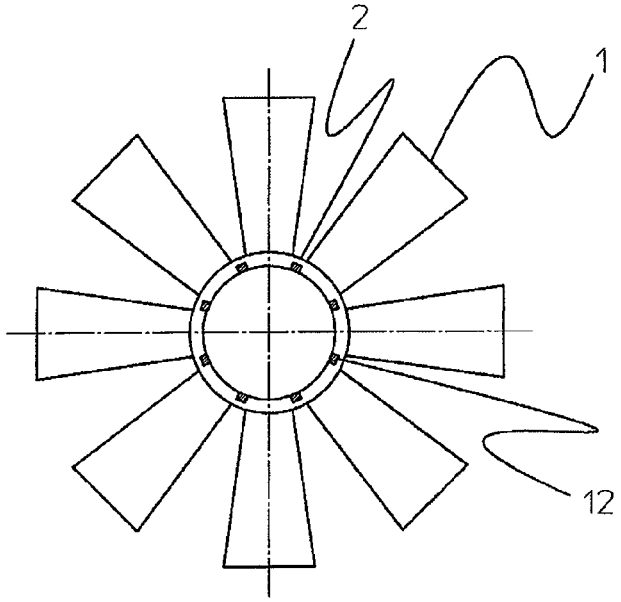

In addition, preferably, as illustrated in FIGS. 6(*a*) and 6(*b*), grooves extending in the same direction as the axial direction of the circular waveguide 2 are formed in the inner wall of the circular waveguide 2 and a radio wave absorber 12 is attached to the grooves in the embodiment. This structure increases the resistance against high-frequency current flowing on the inner wall of the circular waveguide 2, makes it difficult to flow high-frequency current, and suppresses occurrence of an unnecessary mode other than TM01 mode.

In the electric power combining/dividing unit W configured as described above, when the other ends of the rectangular waveguides 1 are used as input ends and electric power is input from the input ends, electric power from the input ends is input to the circular waveguide 2 and combined, and the combined electric power is output from the mode converter 3 connected to the other end of the circular wave guide.

Figure 5:
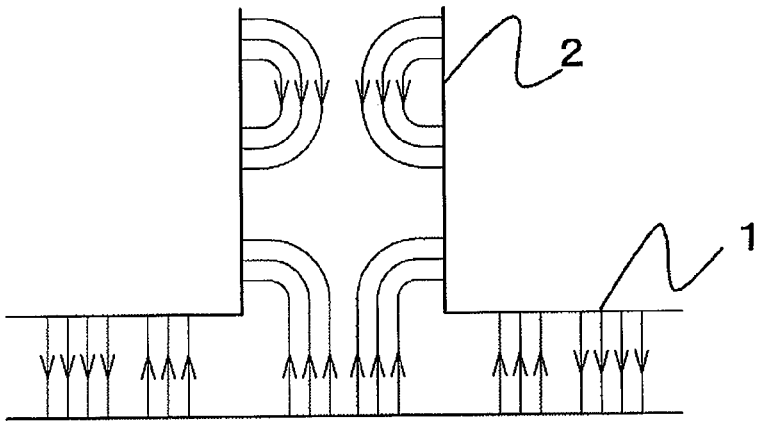
FIG. 5 is a schematic view illustrating the state of the mode in the connection part between the rectangular waveguides and a circular waveguide of the electric power combining/dividing unit according to the embodiment of the invention.

In addition, in the electric power combining/dividing unit W according to the embodiment, as illustrated in FIG. 5, the direction of the electric field of the rectangular waveguide 1 (TE10 mode) is the same as the direction of the electric field of the circular waveguide 2 (TM01 mode) in the state of the mode in the connection portion between the rectangular waveguide 1 and the circular waveguide 2. Therefore, in the embodiment, in the connection portion between the rectangular waveguide 1 and the circular waveguide 2, mode conversion is smoothly performed and good characteristics are obtained.

In addition, in the connection portion between the rectangular waveguide 1 and the circular waveguide 2, the impedance of the rectangular waveguide 1 is connected in parallel to the periphery of the circular waveguide 2. Accordingly, electric power can be combined efficiently by performing matching between the above parallel impedance and the characteristic impedance of the circular waveguide 2.

Since the isolation between the input terminals is approximately ⅛ when inputs from the input ends are excited in the same phase in the electric power combining/dividing unit W according to the embodiment, the performance is approximately 9 dB.

In addition, since the electric power combining/dividing unit W according to the embodiment is formed by waveguides (the rectangular waveguides 1 and the circular waveguide 2), the electric power combining/dividing unit W can be used at high electric power and, if the insides of the waveguides are pressurized by an inactive gas or the waveguides are evacuated, it can be used at higher electric power.

In addition, it is possible to correspond to higher electric power by cooling (cooling with water or air) the outer wall surfaces of the waveguides.

Since, as described above, in the embodiment, there is provided the electric power combining/dividing unit W in which the rectangular waveguides are used as input ends and the other end of the circular waveguide is used as an output end, high electric power can be combined without using the structure of the prior art in which multistage connection of a plurality of electric power combining/dividing units having the input ends of coaxial plugs is performed, the facility cost and installation cost can be significantly reduced as compared with the prior art described above.

In addition, in the embodiment, the mode converter 3 for converting TM01 mode to TE10 mode is connected to the other end side of the circular waveguide 2. That is, since both ends (input end and output end) of the electric power combining/dividing unit are rectangular waveguides in the embodiment, installation to a transmission path formed by the rectangular waveguides becomes easy.

The invention is not limited to the above embodiment and various changes can be made within the scope of the invention.

For example, in the above embodiment, by connecting corner waveguides (vent waveguides), twisted waveguides, or the like to the other end parts of the rectangular waveguides 1 used as input ends and the other end part of the mode converter 3 used as an output end, if the flange surfaces of either or both of the input ends and the output end are changed, output (input) end arrangement having an arbitrary flange surface is enabled.

In addition, although the eight-synthesis electric power combining/dividing unit W including the eight rectangular waveguides 1 which are used as input ends is indicated in the above embodiment, the number of the rectangular waveguides 1 connected to the circular waveguide 2 are set as appropriate.

In addition, although the mode converter 3 is connected to the outer peripheral surface on the other end of the circular waveguide 2 in the above embodiment, the invention is applied even in the structure in which the mode converter 3 is not present.

REFERENCE SIGNS LIST

W: waveguide type power combining/dividing unit
1: rectangular waveguide
2: circular waveguide
3: mode converter
3*a*: circular waveguide part (mode converter)
3*b*: rectangular waveguide part (mode converter)
11: ridge
12: radio wave absorber

The invention claimed is:

1. A waveguide type power combining/dividing unit comprising:

a plurality of rectangular waveguides for TE10 mode disposed in a radial pattern; and a circular waveguide for TM01 mode disposed at a center of a surface of the radial pattern so as to extend orthogonally to the radial pattern, wherein one ends of the plurality of rectangular waveguides are connected to a side surface of one end part of the circular waveguide, wherein either or both of the width of H-planes and the width of E-planes of the rectangular waveguides are reduced from the other end part of the rectangular waveguides toward one end part connected to the circular waveguide in the rectangular waveguide, and wherein a ridge is provided in one or both of the H-planes.

2. The waveguide type power combining/dividing unit according to claim 1, wherein a groove extending in a direction same as an axial direction of the circular waveguide is formed in an inner wall of the circular waveguide, and wherein a radio wave absorber is attached to the groove.

3. The waveguide type power combining/dividing unit according to claim 1, wherein a mode converter for converting TM01 mode to TE10 mode is connected to the other end of the circular waveguide.

4. A waveguide type power combining/dividing unit comprising:

a plurality of rectangular waveguides for TE10 mode disposed in a radial pattern; and a circular waveguide for TM01 mode disposed at a center of the radial pattern so as to extend orthogonally to a surface of the radial pattern, wherein one ends of the plurality of rectangular waveguides are connected to a side surface of one end of the circular waveguide, wherein either or both of the width of H-planes and the width of E-planes of the rectangular waveguides are reduced from the other ends of the rectangular waveguides toward one ends connected to the circular waveguide in the rectangular waveguides, wherein a ridge is provided in one or both of the H-planes, wherein a groove extending in a direction same as an axial direction of the circular waveguide is formed in an inner wall of the circular waveguide, wherein a radio wave absorber is attached to the groove, and wherein a mode converter for converting TM01 mode to TE10 mode is connected to the other end of the circular waveguide.

5. A waveguide type power combining/dividing unit comprising:

a plurality of rectangular waveguides for TE10 mode disposed in a radial pattern; and a circular waveguide for TM01 mode disposed at a center of a surface of the radial pattern so as to extend orthogonally to the radial pattern, wherein one ends of the plurality of rectangular waveguides are connected to a side surface of one end part of the circular waveguide, and wherein either or both of the width of H-planes and the width of E-planes of the rectangular waveguides are reduced from the other end part of the rectangular waveguides toward one end part connected to the circular waveguide in the rectangular waveguide.

6. A waveguide type power combining/dividing unit comprising:

a plurality of rectangular waveguides for TE10 mode disposed in a radial pattern; and a circular waveguide for TM01 mode disposed at a center of a surface of the radial pattern so as to extend orthogonally to the radial pattern, wherein one ends of the plurality of rectangular waveguides are connected to a side surface of one end part of the circular waveguide, and wherein a ridge is provided in one or both of the H-planes.

* * * * *